US007681499B2

(12) United States Patent
Akiyama

(10) Patent No.: US 7,681,499 B2
(45) **Date of Patent: *Mar. 23, 2010**

(54) GAP FILLING MEMBER FOR BLANKET CYLINDER

(75) Inventor: Sadanobu Akiyama, Kawasaki (JP)

(73) Assignee: Kabushikikaisha Tokyo Kikai Seisakusho, Tokyo (JP)

( * ) Notice: Subject to any disclaimer, the term of this patent is extended or adjusted under 35 U.S.C. 154(b) by 177 days.

This patent is subject to a terminal disclaimer.

(21) Appl. No.: 11/978,592

(22) Filed: Oct. 30, 2007

(65) Prior Publication Data

US 2009/0139418 A1 Jun. 4, 2009

(51) Int. Cl.
*B41F 27/00* (2006.01)

(52) U.S. Cl. ..... 101/375; 101/217; 101/415.1

(58) Field of Classification Search ..... 101/217
See application file for complete search history.

(56) References Cited

U.S. PATENT DOCUMENTS

| | | | | | |
|---|---|---|---|---|---|
| 3,276,365 | A | * | 10/1966 | Langer | 101/415.1 |
| 4,515,375 | A | * | 5/1985 | Bleckmann et al. | 101/415.1 |
| 4,635,550 | A | | 1/1987 | Brands et al. | 101/415.1 |
| 4,742,769 | A | | 5/1988 | Zeller | 101/216 |
| 4,896,603 | A | * | 1/1990 | Dorow et al. | 101/375 |
| 4,964,338 | A | | 10/1990 | Fantoni et al. | 101/378 |
| 5,090,319 | A | * | 2/1992 | Weber et al. | 101/375 |
| 5,125,337 | A | | 6/1992 | Zeller | 101/217 |
| 5,178,068 | A | * | 1/1993 | Junghans et al. | 101/415.1 |
| 5,351,615 | A | * | 10/1994 | Kobler et al. | 101/217 |
| 6,073,558 | A | * | 6/2000 | Jones | 101/415.1 |
| 6,286,427 | B1 | * | 9/2001 | Smith | 101/375 |
| 7,350,462 | B2 | * | 4/2008 | Akiyama | 101/375 |

FOREIGN PATENT DOCUMENTS

| | | |
|---|---|---|
| JP | 63-3442 | 1/1988 |
| JP | 5-65537 | 8/1993 |
| JP | 8-118603 | 5/1996 |
| JP | 2002-127366 | 5/2002 |
| JP | 2002-326341 | 11/2002 |

* cited by examiner

*Primary Examiner*—Jill E Culler
(74) *Attorney, Agent, or Firm*—Morgan Lewis & Bockius LLP

(57) ABSTRACT

A filling member for filling the concave portion of a blanket face which is generated along the opening portion of a groove of a blanket cylinder comprises a wedge-shaped limb portion and a head portion capable of filling the concave portion. The limb portion is inserted between the surface of the terminal and initial winding end side of the blanket which is approximately parallel with the surface in a condition in which one face of the limb portion is brought into contact with the terminal winding end side of the blanket and is pushed on both surfaces in which one face and another face forming a wedge shape for the one face oppose approximately parallel to at least a site adjacent to the head portion. The head portion can fill the concave portion when the limb portion is inserted between the initial winding end side and the terminal winding end side of the blanket. The face portion of the head portion which is at least farther side from the limb portion is formed in a comparatively soft sense, thereby the installation and removal of the blanket cylinder is easily carried out, and the influence of the installation and removal to the blanket cylinder and printing pressure at printing is hardly affected.

3 Claims, 11 Drawing Sheets

GAP FILLING MEMBER FOR BLANKET CYLINDER

BACKGROUND

1. Field of the Invention

The present invention relates to a gap filling member for a blanket cylinder for filling the concave portion of a blanket face which is generated along the opening portion of a groove of the blanket cylinder and which is strained and installed by a blanket installing means provided in the groove opening on the outer peripheral face on which a sheet-shaped blanket is wound and with which the initial winding end side and the terminal winding end side are linked through a bar for blanket installation.

2. Description of the Related Art

The aforementioned gap filling member for a blanket cylinder (hereinafter, referred to as the "filling member") is shown in, for example, Japanese Patent Publication (Unexamined) Hei No. 8-118603 (hereinafter, referred to as JP-A-8-118603), JP-A-2002-127366 and JP-A-2002-326341.

In JP-A-8-118603, there is described a buffering device for a printing cylinder which can overcome printing hindrances such as shock-streak that is generated by fluctuation of printing pressure, and doubling, by filling a buffering member in a clearance after installing printing equipment parts in the gap provided in printing cylinders such as a printing cylinder and a blanket cylinder, removing the aforementioned clearance, and removing the great fluctuation of printing pressure caused by the clearance. Further, the buffering member of the buffering device is formed in one sheet or in multiple sheets in the width direction (longitudinal direction) of the blanket cylinder (printing cylinder). The buffering member consists of a head portion made of an elastic member and a tabular inserting limb having a uniform thickness. The inserting limb can be also filled by being slanted to the radial direction of a printing cylinder, and the outer peripheral face of the head portion is adjusted in a filled condition so as to coincide with the outer peripheral face when a blanket (printing equipment parts) is installed on a blanket cylinder (printing cylinder). When the inserting limb is obliquely inserted against the radial direction of the printing cylinder, it is not sprung from the clearance even if a centrifugal force is formed by rotation of the printing cylinder.

Further, in JP-A-2002-127366, there is described a filling member consisting of a member having rubber elasticity which is filled in a groove along the radius of a blanket cylinder in order to block the groove remaining at the facing portion of the blanket surface along a blanket inserting groove after the blanket is inserted and installed in the blanket inserting. The filling member is formed in a wedge-shape, in which a width dimension vertical to a longitudinal direction at an upper face situated at the peripheral face side of the blanket cylinder when it is filled, is larger than the lower face which is a preceding side when it is filled. The filling member further provides a level difference, which carries out an action of preventing drop-out when it is filled, having at least one side of the wedge-shaped form along a longitudinal direction.

Further, in JP-A-2002-326341, there is described a pressing insertion article having elasticity, which is made of a metal, a rubber or a resin, which is inserted in a non shrinking blanket. The initial winding end vicinity portion and the terminal winding end vicinity portion of the insertion article after winding on a printing cylinder, is inserted in an inserting groove provided in the printing cylinder, by pressing between the initial end vicinity portion and the terminal end vicinity portion which are inserted in the inserting groove in order to fix it on said printing cylinder. Pressure is exerted on the wall face of the groove through the initial end vicinity portion and the terminal end vicinity portion. Furthermore, as one of the pressing insertion articles, there is described a device for fixing a blanket equipped with a quasi blanket face at its one end, in which the aforementioned quasi blanket face is situated on the same peripheral face as the blanket surface wound between the aforementioned initial end vicinity portion and the terminal end vicinity portion of the blanket. The groove of the blanket surface is visually removed and thereby, the invasion of paper powder, ink and the like are prevented.

However, techniques described in the above-mentioned respective Publications have had problems which should be solved.

Namely, in the buffering member of a buffering device described in JP-A-8-118603, when the tabular inserting limb having a uniform thickness is inserted in the clearance produced after a printing equipment part is installed on a printing cylinder, comparatively great frictional force is created between the inserting limb and the printing equipment part. Accordingly, when the head portion of the buffering member is inserted in the aforementioned clearance, force is created on the linking portion of both in concentration caused by the great difference of compression elastic coefficients between the inserting limb and the printing equipment part. There is a fear that the edge of the tabular inserting limb having rigidity necessary for insertion into the clearance, intrudes into the head portion of the elastic member to damage the head portion comprising the elastic member. Therefore a skilled technique is required for the insertion. Further, when the thickness of the inserting limb is smaller than the aforementioned clearance so that the inserting limb can be easily inserted into the clearance of the printing equipment parts, there is no force in the clearance of the printing equipment parts even if the inserting limb is obliquely inserted against the radial direction of the printing cylinder. There has been much fear that the inserting limb is sprung out from the clearance of the printing equipment part by centrifugal force caused by rotation of the printing cylinder during printing operation, is sandwiched between the printing cylinder rotating, and damages these parts.

Further, in the filling member described in JP-A-2002-127366, it is required that the member is filled in the radial direction of the cylinder in the opening portion of the blanket face which was installed in a strained condition approximately parallel to the radial direction of the printing cylinder by the blanket installing means by which the initial end nearby portion of winding the blanket and the terminal end nearby portion of winding were provided in the groove of the cylinder. The filling member remains in the groove without dropping out by a force such as the centrifugal force created by the rotation of the blanket cylinder and created during printing operation.

Consequently, the filling member is formed at a sufficiently larger width than the distance of the groove into which it is inserted, and when it is inserted into the groove, it remains in the groove while strongly pressing groove walls through the blanket. Therefore, much effort and skill were required to remove this when replacing the blanket. Further, since the filled edge of the filling member does not reach the bottom of the groove, it is occasionally pushed in the inside of the groove by pressure, which is created in a radial direction. Accordingly, if a groove has a narrowest rim portion at the opening portion in which the inside is formed like an unfolded fan, when the tension of the blanket by the aforementioned blanket installing means is released for replacement of the blanket, there is a strong pressure on the wall of the groove through the blanket occasionally in a condition in which a force occasionally is created in the inside than the rim portion of the aforementioned opening portion. Therefore the removal of the filling member is extremely difficult, the member drops into the groove occasionally, and time is wasted.

Further, in the fixation device of a blanket described in JP-A-2002-326341, fairly great force is required at insertion for firmly fixing the blanket by inserting the pressuring insertion article in the groove so that it is not floated from the outer peripheral face of the printing cylinder and not removed from the groove by vibration and centrifugal force during printing. Further, in the fixation device of a blanket in which a quasi blanket face is situated on the same peripheral face as the blanket surface, a skilled technique together with the above-mentioned great force is required in order to insert the pressuring insertion article by pressuring so as to be a uniform depth over the whole length of the groove.

Furthermore, in the fixation device of a blanket in which the quasi blanket face is situated on the same peripheral face as the blanket surface and the groove of the blanket surface is visually eliminated, the quasi blanket face is displaced and moved during printing in which high pressure is created because a space exists under the quasi blanket face. The invasion of paper powder, and ink and the like cannot be prevented perfectly, and the fluctuation of printing pressure is generated by the displacement movement and hindrances, such as shock-streak and doubling which are generated by the fluctuation of printing pressure could not be prevented. Further, when the pressing insertion article is inserted by pressing in the fixation device of a blanket, extremely great frictional force is created between the pressing insertion article and the preceding end and succeeding end of the blanket, and extremely great force is required for the insertion. Not only the above-mentioned great force, but also a skilled technique is required in order to insert the pressing insertion article by pressing so as to be a uniform depth over the whole length of the groove so that the quasi blanket face is situated on the same peripheral face as the blanket surface, in like manner as a case of insertion by pressing the fixation device in which a space exists under the aforementioned quasi blanket face.

The present invention solves the above-mentioned problems and provides a filling member in which, although slight force is required for insertion to a blanket cylinder and removal from the blanket cylinder for filling the concave portion of the surface of the blanket cylinder, the insertion to a blanket cylinder and removal from the blanket cylinder can be easily carried out without requiring any skilled technique. Further the filling member is not removed from the blanket cylinder even if centrifugal force is created during printing operation.

Further the head portion is not damaged at installation by enabling the installation to the blanket cylinder by comparatively small force, and further the position in which it is installed is not changed by contacting the important points of the wedge-shaped limb portion on one or both of the blanket and a bar for installation of the blanket even if printing pressure and other force is created during printing operation.

SUMMARY

The present invention achieves the aforementioned purposes by the composition described in the scope of claims for patent.

Namely, the gap filling member for a blanket cylinder described in the present invention is a filling member which fills the concave portion of a blanket face which is generated along the opening portion of a groove of the blanket cylinder, in which the inner wall of the groove opened at the outer peripheral face of the cylinder in parallel with an axial line is provided at a fixed sharp angle against the radius direction of the cylinder at the center of the cylinder peripheral face of the opening portion, the blanket being wound on the outer peripheral face of the cylinder, the initial winding end side and the terminal winding end side of the blanket respectively being linked with a blanket installation means which is provided in the groove by a bar for blanket installation and the blanket being strained approximately parallel with the inner wall face by the blanket installation means, characterized in that it comprises a wedge-shaped limb portion and a head portion capable of filling the concave portion, wherein the limb portion is strengthened to be inserted between the surface of the terminal winding end side of the blanket face and the surface of the initial winding end side of the blanket face approximately parallel with the surfaces in a condition in which one face of the limb portion is contacted with the surface of the terminal winding end side of the blanket strained along the inner wall face and is formed in a shape in which the one face and another face forming a wedge-shape with the one face can be pushed on the both surfaces which face approximately parallel to at least a site adjacent to the head portion the head portion is formed in a shape capable of filling the concave portion when the limb portion is inserted between the initial winding end side and the terminal winding end of the blanket and at least a face portion of the head portion at farther side from the limb portion is formed in a comparatively soft sense by an elastomer.

According to the composition, the wedge-shaped limb portion is inserted and installed along the blanket which is strained along the inner wall face of a groove provided in a sharp angle against the radial direction of the cylinder and installed approximately parallel and adjacent to at least the head portion of both faces forming a wedge shape, the limb portion being pushed on the aforementioned blanket faces facing approximately parallel. Therefore even if the separate centrifugal force generated during printing operation is created in a pulling-up direction, a frictional force caused by the contact of the limb portion with the blanket faces resists the aforementioned separate centrifugal force and the filling member is not removed from the blanket cylinder.

Further, since the insertion direction at installation is different from the action direction of printing pressure, and further the head portion fills the concave portion of the blanket faces, the head portion formed in a comparatively soft sense corresponds to the printing pressure during printing operation to minimize the fluctuation of the printing pressure. The aforementioned frictional force caused by the contact of the limb portion with the blanket faces and the head portion filling the concave portion of the blanket faces keep the position the same as was installed.

Further, since the limb portion is a wedge shape and can be inserted or pulled out between the surface at the initial winding end side of the blanket and the surface of the terminal winding end side facing approximately parallel, in a condition in which one face of the wedge-shaped limb portion is brought into contact with the surface of the terminal winding end side of the blanket, the installation and removal to the blanket cylinder of the filling member can be carried out without requiring any skilled technique and with comparatively small force.

Further, the gap filling member for blanket cylinder related to the present invention is preferably formed so that the edge of the limb portion is brought into contact with the rising face of a level difference that rises from the blanket face of the bar for blanket installation, which was provided at the initial winding end.

Since the edge of the limb portion is brought into contact with the rising face of level difference that rises from the blanket face of the bar for blanket installation, a repulsive force corresponding to the separate printing pressure is generated, and the combination of the frictional force caused by the contact of the limb portion with the blanket faces, and the action of the head portion filling the concave portion of the blanket faces, maintains the filling member in its initial position for a longer time.

Further, the gap filling member for a blanket cylinder related to the present invention is preferably formed so that the other face forming the wedge shape of the limb portion is brought in contact with the upper face of level difference that rises from the blanket face of the bar for blanket installation, which was provided at the initial winding end.

Since the other face forming the wedge shape of the limb portion is brought into contact with the upper face of level difference that rises from the blanket face of the bar for blanket installation, the blanket is strongly stripped off to the terminal winding end side by printing operation, which rotates in contact with the adjacent cylinder, force facing to the inside of the groove is created on the one face of the wedge-shaped limb portion being brought into contact with when the terminal winding end side is slightly sent in the inside of the groove. The filling member prevents the displacement of an angle to the initial winding end side by using the contact portion of the initial winding end side of the blanket with the other face of the limb portion as a fulcrum, and thus the initial position of the filling member is maintained.

Further, the gap filling member for a blanket cylinder related to the present invention is preferably a member wherein the head portion and the limb portion are formed by the same elastomer and the face vicinity of the head portion, which is at least at a farther side from the limb portion, is formed at a Shore hardness of 30 to 80 degrees and the limb portion is formed at a Shore hardness of 90 to 100 degrees.

Since the filling member is integrally formed by the same elastomer material, production cost can be reduced. Further, since the limb portion can adequately endure the insertion of the filling member and the face forming the portion of the outer peripheral face of the blanket cylinder, which is at a farther side from the limb portion of the head portion, can be equipped with about the same cushion property as the blanket faces, and the fluctuation of the printing pressure can be surely prevented. Furthermore, the boundary between the hard portion and the soft portion is formed by a layer having a slight thickness in which hardness is gradually changed and force, which is concentrated to the boundary between the hard portion and the soft portion because of the remarkable difference in compression elastic coefficient, is mitigated.

Further, the gap filling member for blanket cylinder related to the present invention is preferably a member wherein the limb portion is formed by the same elastomer as the head portion and a hard reinforcing plate material.

There is no problem that the elastomer portion, which composes almost the filling member, is formed at the same hardness, namely, at a hardness which is required from the viewpoint of the face which is at a farther side from the limb portion of the head portion, and the preparation step of the elastomer used for the formation is extremely simple. Further, the limb portion, which was reinforced with a reinforcing member, has adequate strength for inserting between the surface of the initial winding end side and the surface of the terminal winding end of the blanket. The repulsive force corresponding to the separate force of the printing pressure obtained by the above-mentioned filling member and the action of preventing the displacement of an angle to the initial winding end side are more efficiently obtained.

Further, the gap filling member for a blanket cylinder related to the present invention is preferably a member wherein the limb portion is formed by a hard material different from the head portion.

When the whole limb portion made of the filling member, which was formed by a hard material, is inserted between the surface of the initial winding end side and the surface of the terminal winding end of the blanket, the frictional force caused by the contact with the blanket faces at a site adjacent to the head portion is little different between one face forming the wedge shape and other face, and the insertion can be more easily carried out. Further, the limb portion has adequate strength for the aforementioned insertion and the repulsive force corresponding to the printing pressure faced by the above-mentioned filling member. Thus the action of preventing the displacement of an angle to the initial winding end side is more efficiently obtained.

Further, the gap filling member for blanket cylinder related to the present invention is preferably a member wherein the head portion and the limb portion are formed by a nitrile-butadiene rubber and about 1.5 mm to about 2 mm from the top of the head portion is formed in soft sense.

Since the filling member is formed by a nitrile-butadiene rubber, the filling member of the blanket cylinder exhibiting desired action effect can be provided at less expense.

Further, the gap filling member for blanket cylinder related to the present invention has preferably a circumferential face shape comprising a radius by which the top of the head portion is nearly coordinated with the outer peripheral face of the blanket cylinder after installation.

The filling member can exhibit a desired action effect by having such shape.

Further, the gap filling member for a blanket cylinder related to the present invention is preferably a member in which the top of the head portion is tabular.

The filling member can exhibit a desired action effect by having such shape while the filling member secures the ease of molding.

BRIEF DESCRIPTION OF THE DRAWINGS

The foregoing and other features of the present invention will become apparent to those skilled in the art to which the present invention relates from reading the following description with reference to the accompanying drawings in which.

DESCRIPTION OF THE PREFERRED EMBODIMENTS

The embodiments of the present invention are illustrated with reference to the drawings.

Figure 1:
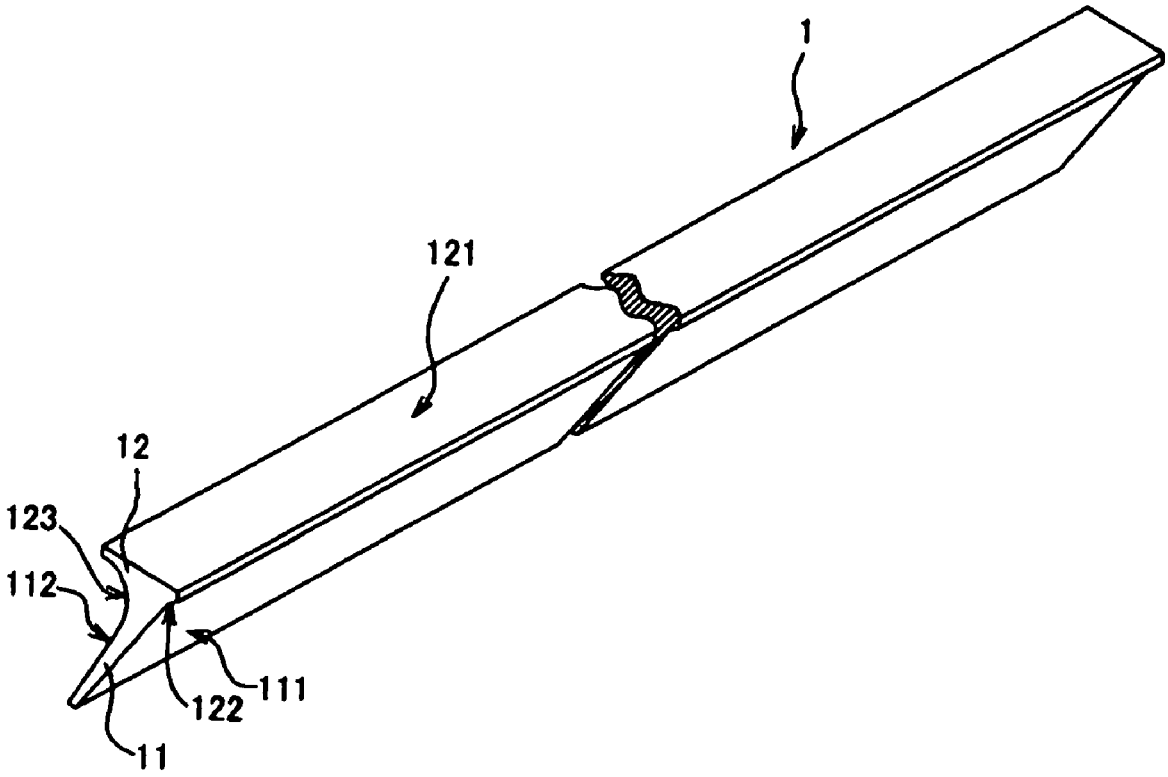
FIG. 1 is a perspective view showing an embodiment of the filling member related to the present invention.
Figure 2:
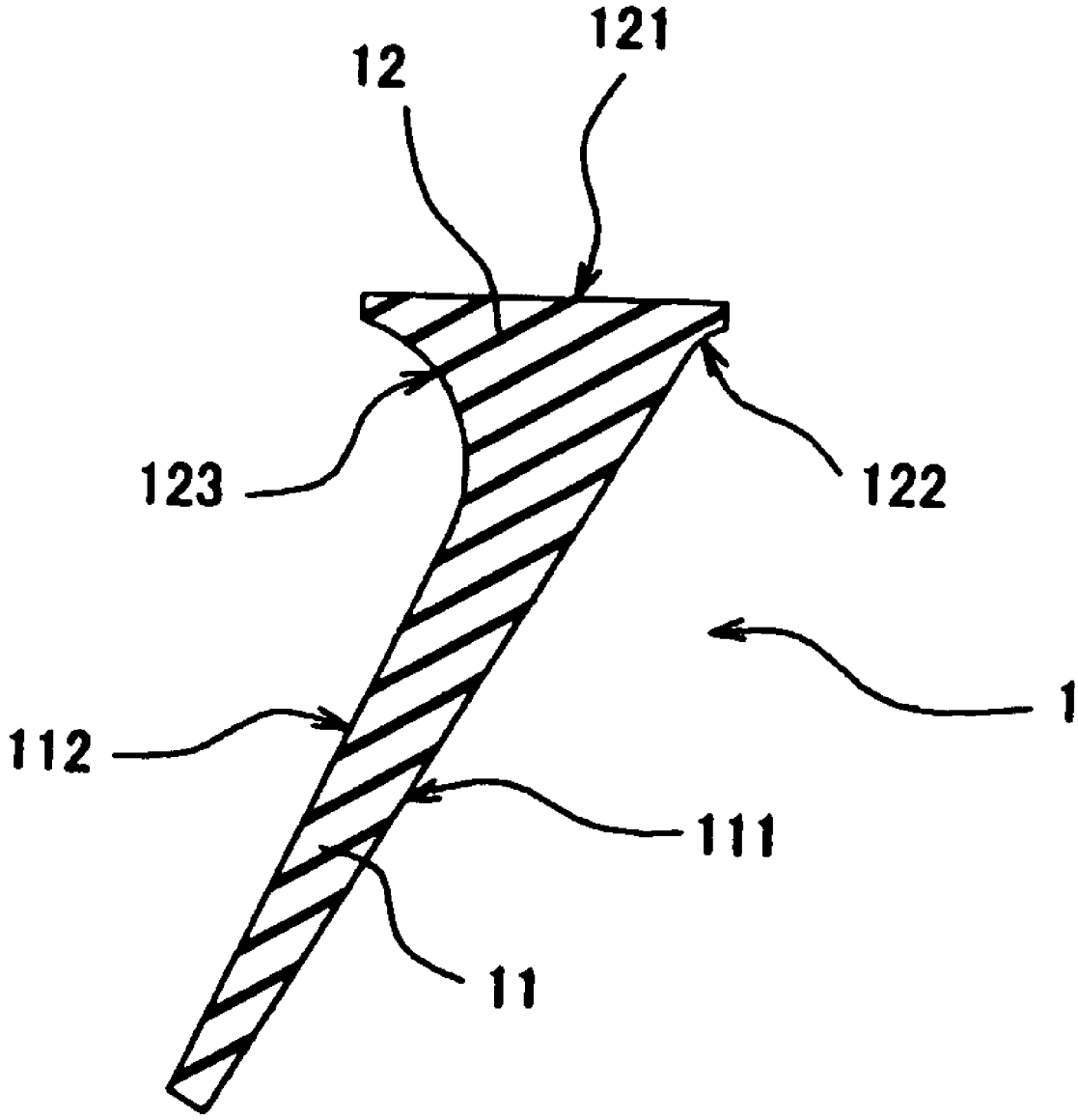
FIG. 2 is a sectional view vertical to the longitudinal direction of the filling member shown in FIG. 1.
Figure 3:
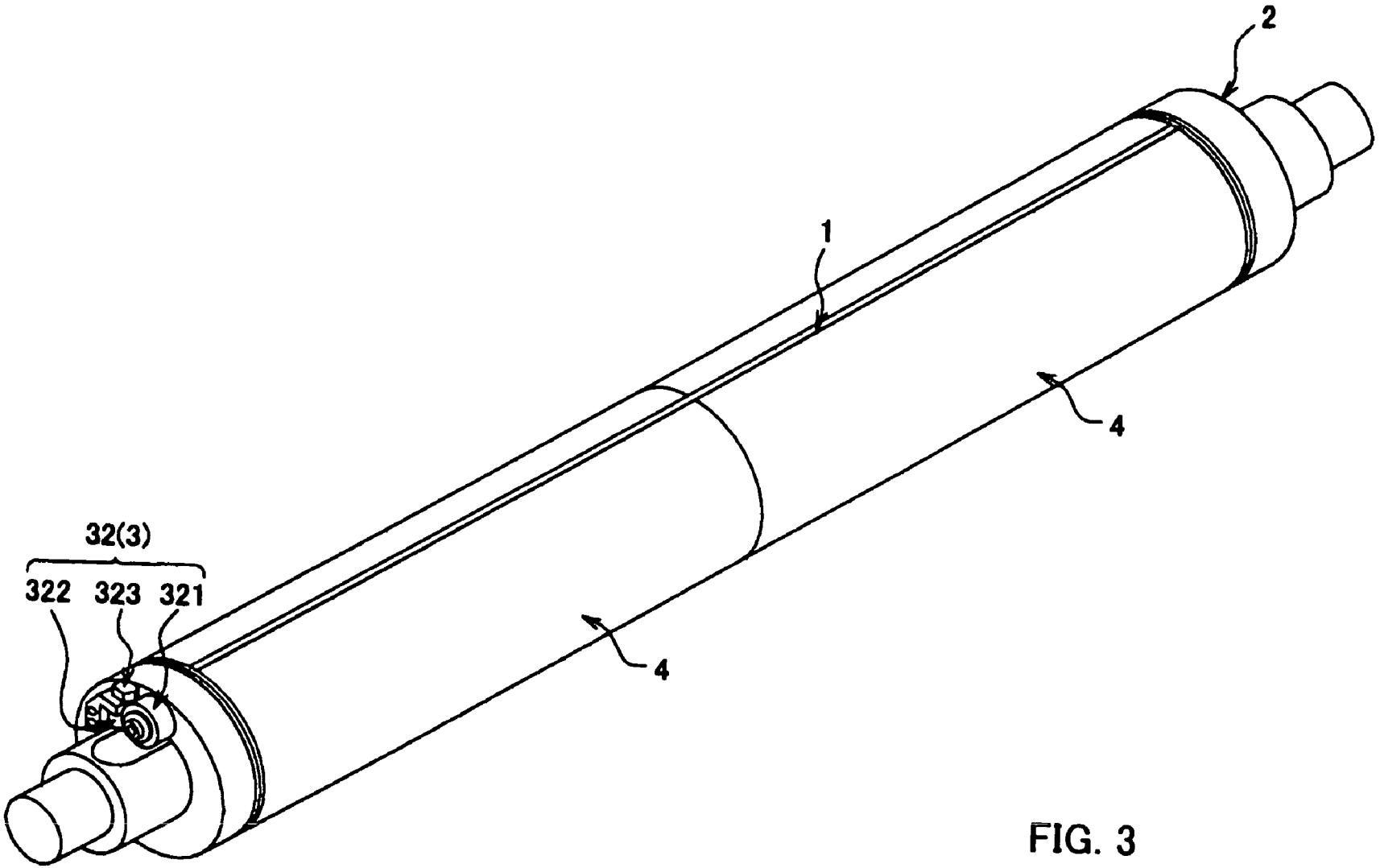
FIG. 3 is a perspective view of the blanket cylinder on which the filling member related to the present invention is installed.
Figure 4:
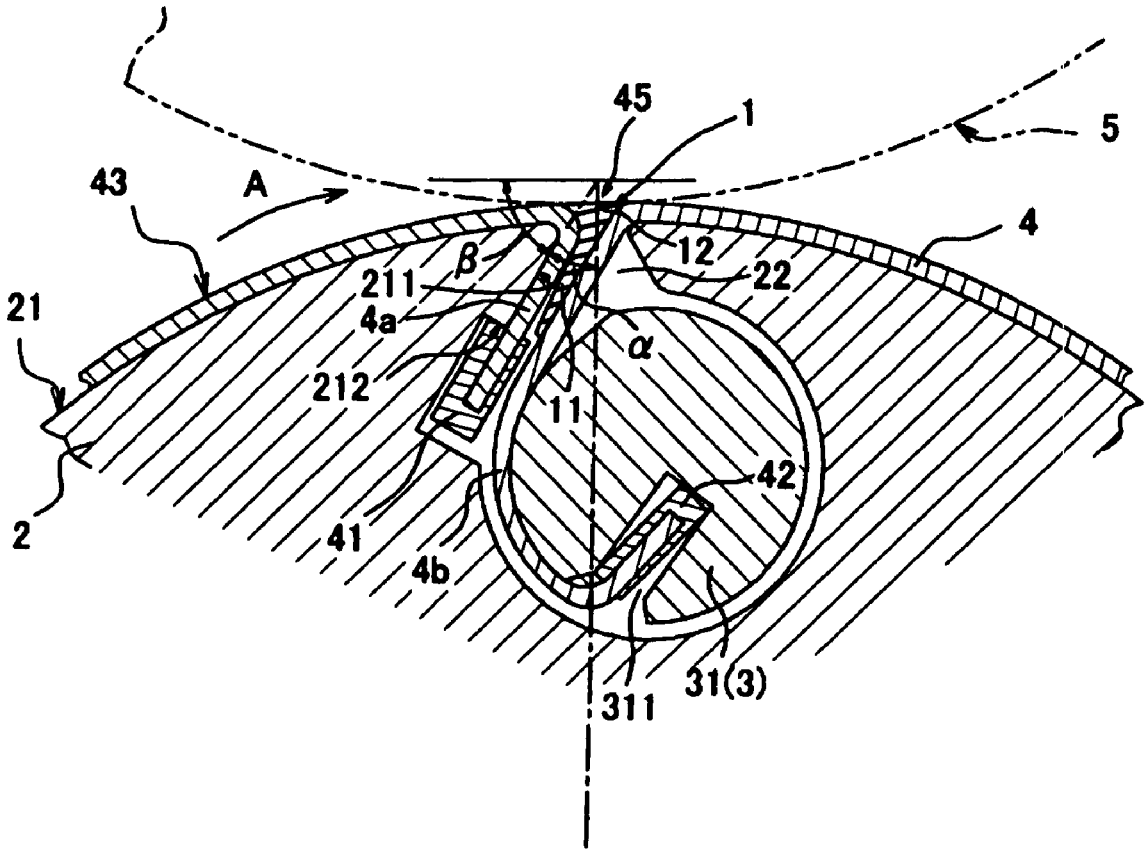
FIG. 4 is a partial sectional view vertical to the axial direction of a cylinder showing the filling member installing portion of the blanket cylinder in magnification.
Figure 5:
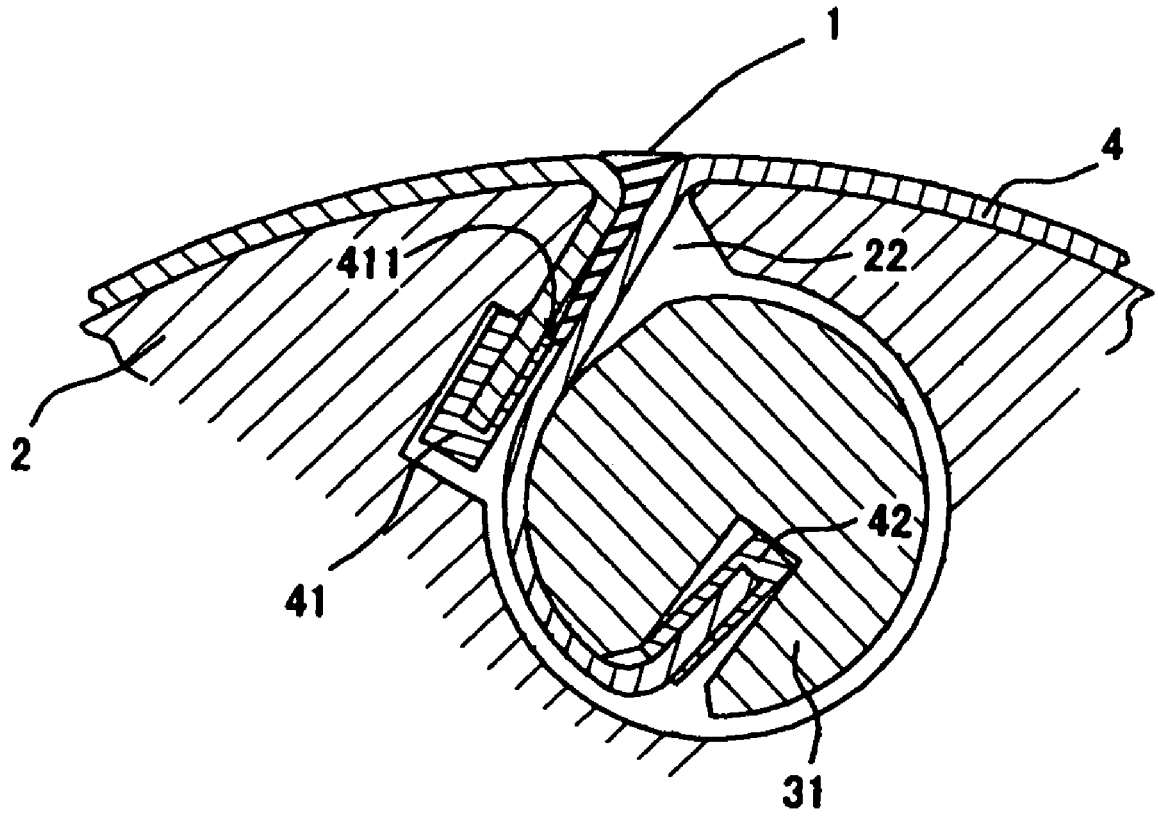
FIG. 5 is a partial sectional view vertical to the axial direction of a cylinder showing an installation condition different from the filling member installing condition shown in FIG. 4 by magnifying the filling member installing portion of the blanket cylinder.
Figure 6:
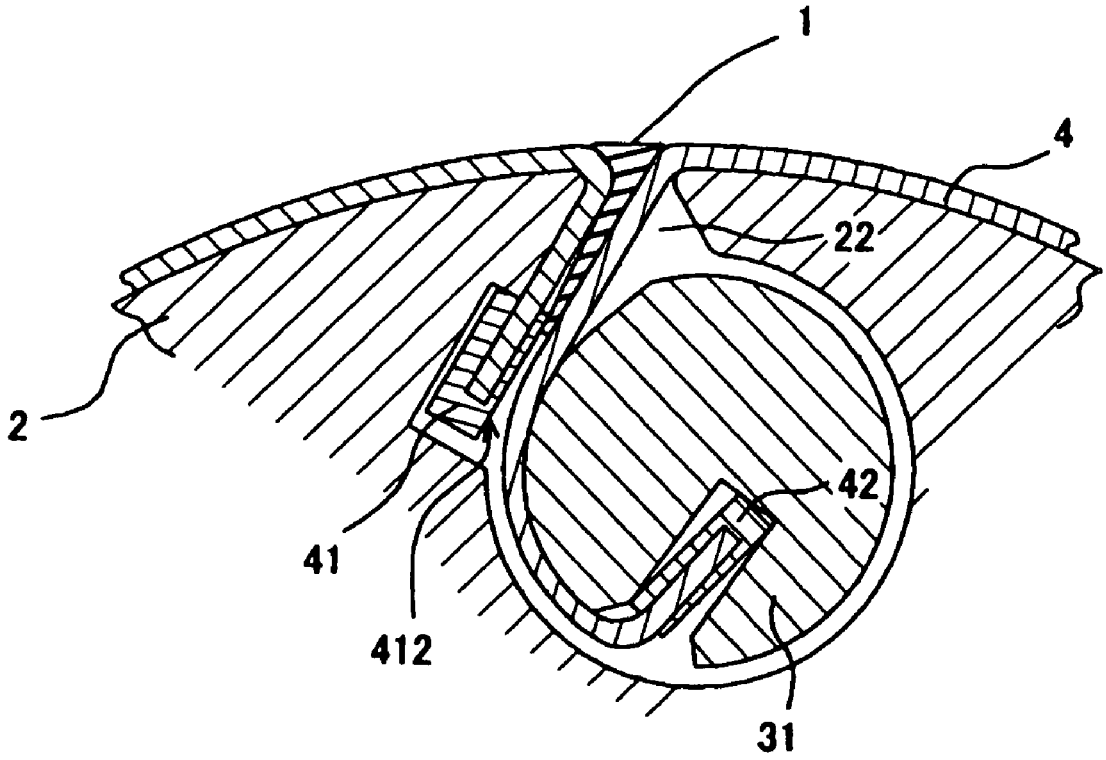
FIG. 6 is a partial sectional view vertical to the axial direction of a cylinder showing an installation condition different from the filling member installing condition shown in FIG. 4 and FIG. 5 by magnifying the filling member installing portion of the blanket cylinder.
Figure 7:
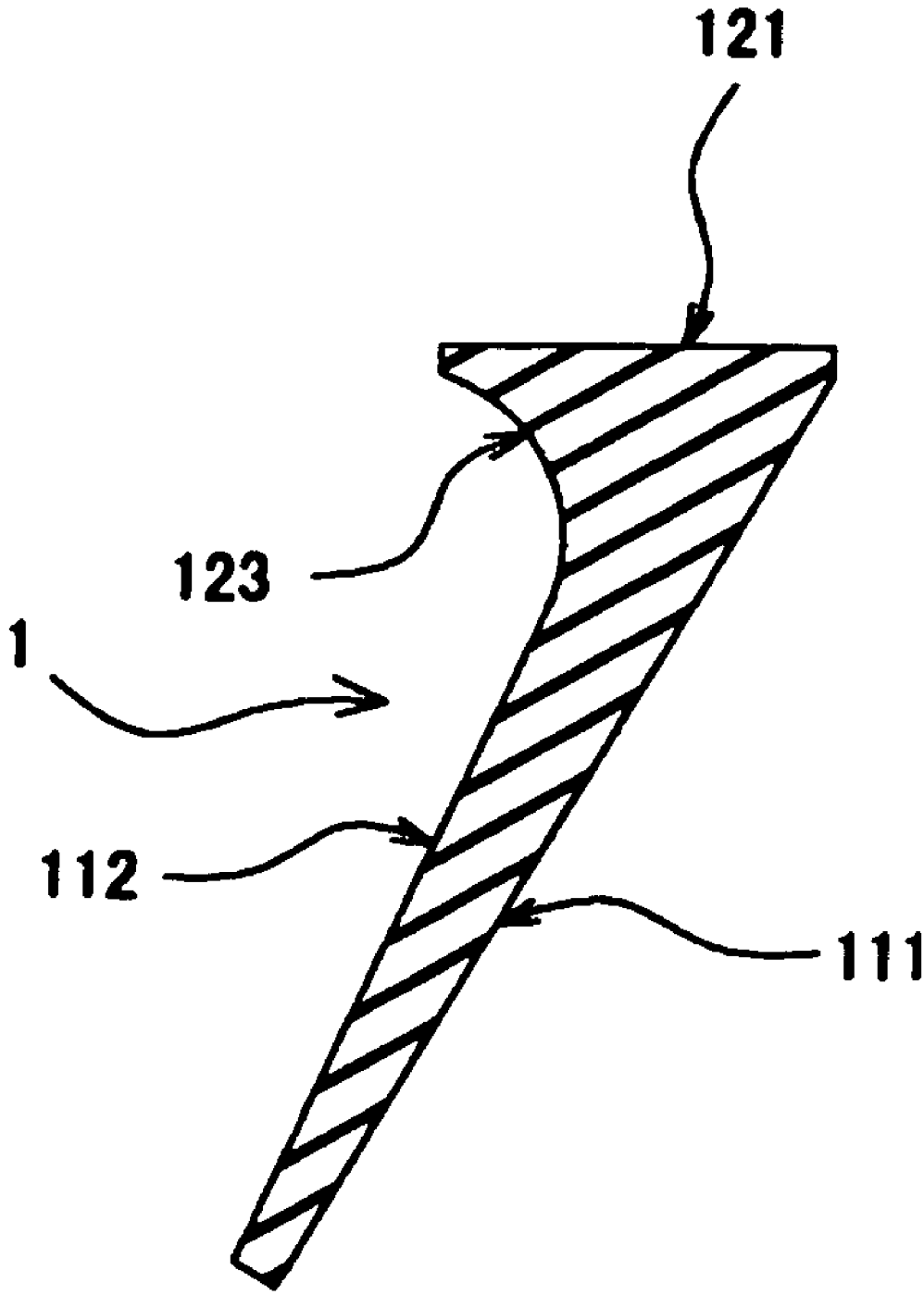
FIG. 7 is a sectional view vertical to the longitudinal direction of the filling member having a shape different from the filling member shown in FIG. 1.
Figure 8:
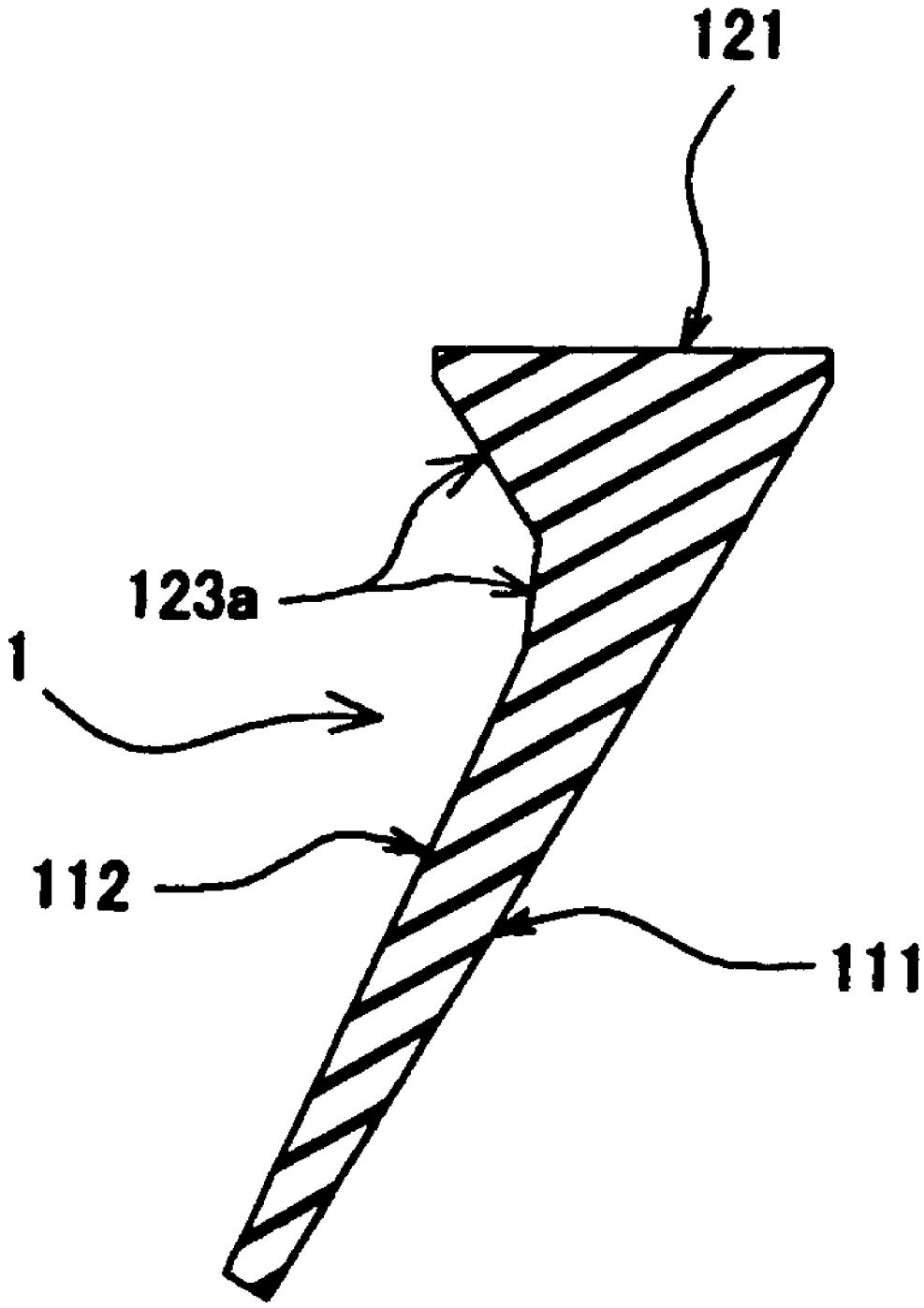
FIG. 8 is a sectional view vertical to the longitudinal direction of the filling member having a shape different from the filling members shown in FIG. 1 and FIG. 7.
Figure 9:
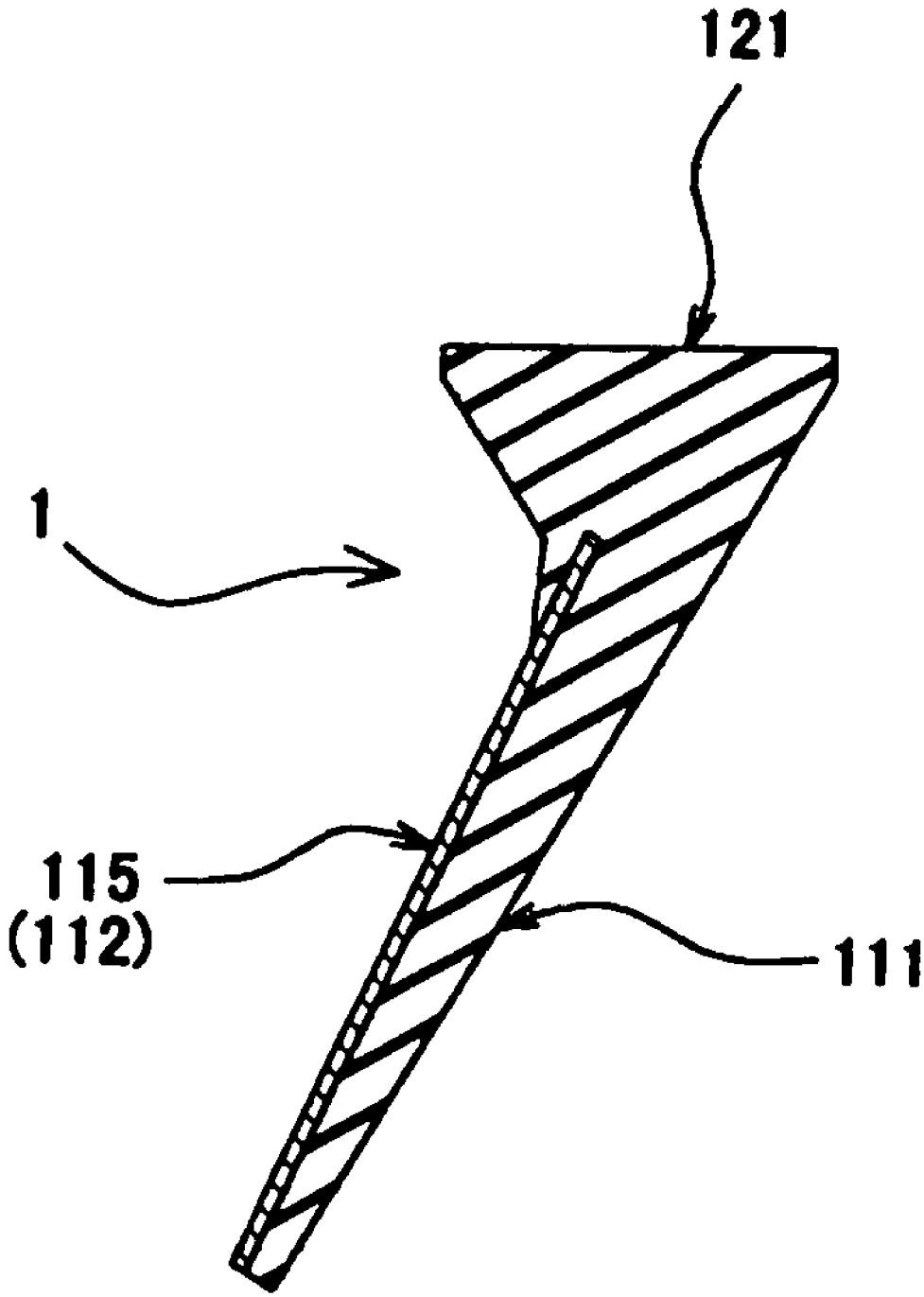
FIG. 9 is a sectional view vertical to the longitudinal direction of the filling member having a composition different from the filling members shown in FIG. 1, FIG. 7 and FIG. 8.
Figure 10:
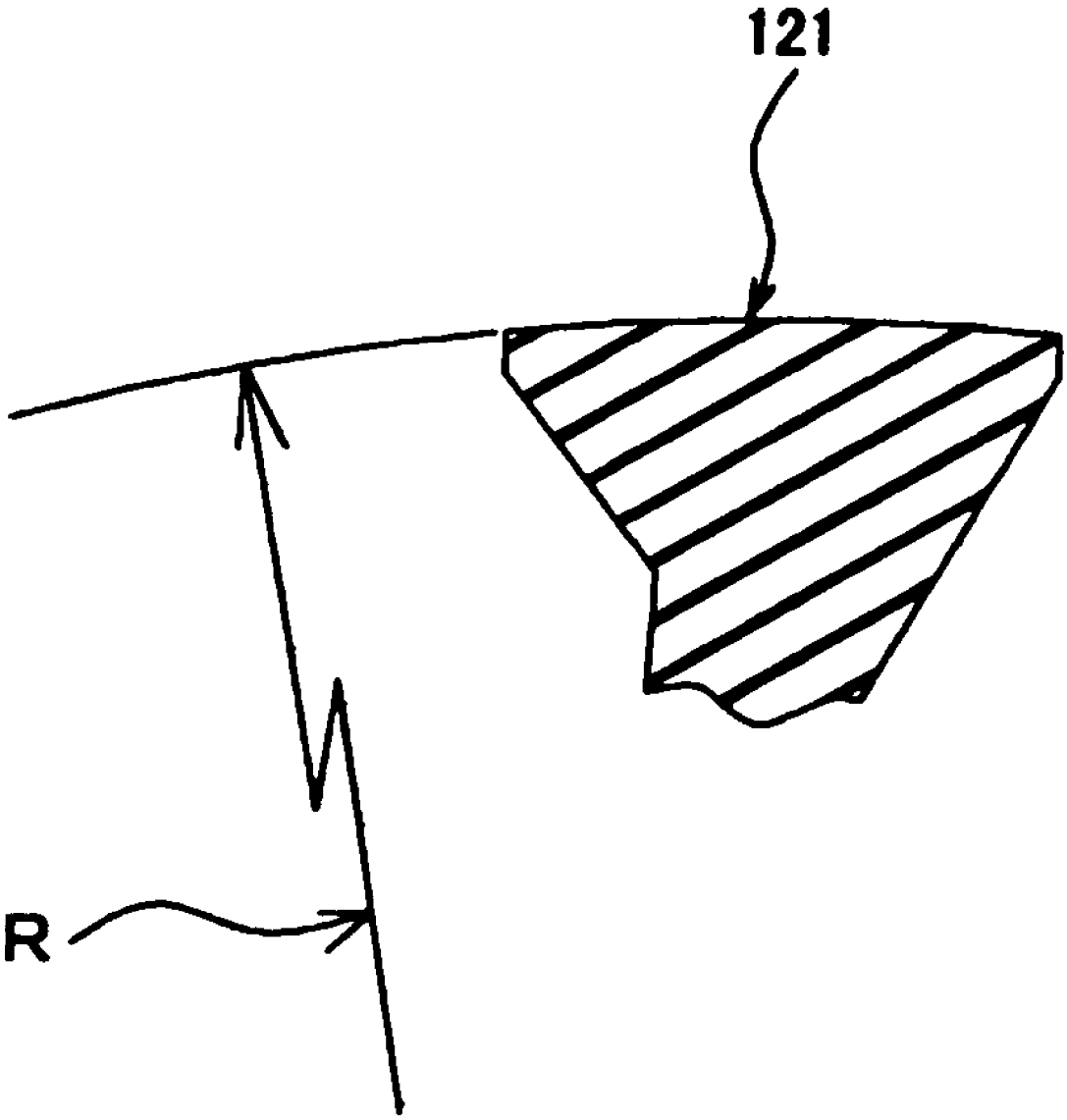
FIG. 10 is a sectional view vertical to the longitudinal direction showing a shape at a side farther from the limb portion of the head portion of the filling member having a shape different from the filling members shown in FIG. 1, FIG. 7, FIG. 8 and FIG. 9.
Figure 11:
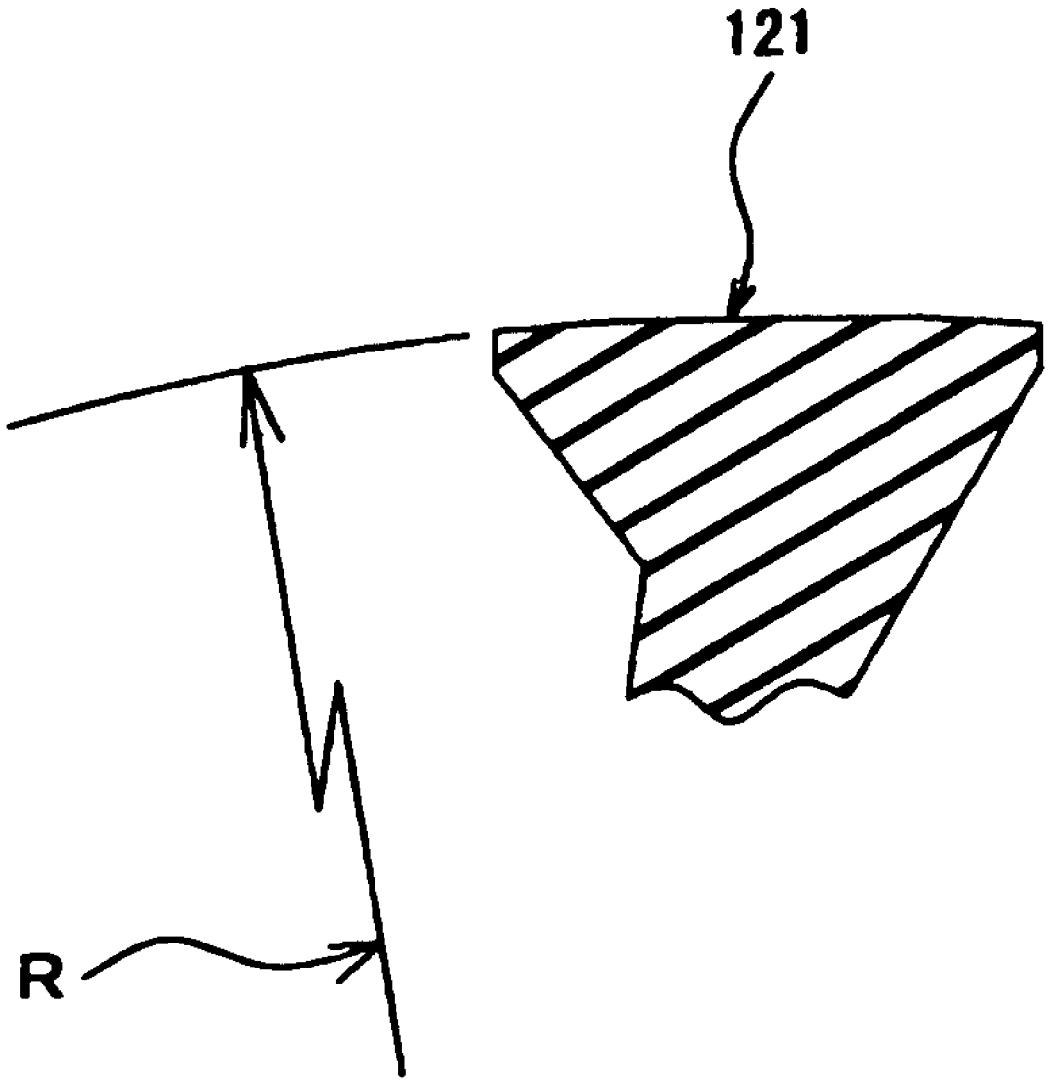
FIG. 11 is a sectional view vertical to the longitudinal direction showing a shape at a side farther from the limb portion of the head portion of the filling member having a shape different from the filling members shown in FIG. 1, FIG. 7, FIG. 8, FIG. 9 and FIG. 10.

FIG. 1 is a perspective view showing the embodiment of the filling member related to the present invention, FIG. 2 is a sectional view vertical to the longitudinal direction of the filling member shown in FIG. 1, FIG. 3 is a perspective view showing the blanket cylinder on which the filling member related to the present invention was installed, FIG. 4 is a partial sectional view vertical to the axial direction of a cylinder showing the filling member installing portion of the blanket cylinder shown in FIG. 3 in magnification, FIG. 5 and FIG. 6 are partial sectional views vertical to the axial direction of a cylinder showing an installation condition different from the filling member installing condition shown in FIG. 4 in magnification, FIG. 7 to FIG. 9 are sectional views vertical to the longitudinal direction of the filling members having a shape or a composition different from the filling member shown in FIG. 1, and FIG. 10 and FIG. 11 are views showing a sectional shape vertical to the longitudinal direction at a side farther from the limb portion of the head portion of the filling member.

As shown in FIG. 4, a groove 22 which is parallel to an axial center opening on outer peripheral face 21 is provided on a blanket cylinder 2 at a slightly longer length than the maximum width of a printing image of blanket cylinder 2. An inner wall face 211 at an upstream side against a rotational direction A during printing operation is provided in the groove 22 so as to be a predetermined sharp angle $\alpha$ against a radial direction at the center of a peripheral face direction of an opening portion. A level difference 212 is formed by cutting down the inner wall face 211 being slightly inside from the opening portion, by an appropriate width and depth, and further, the blanket winding axis 31 of a blanket installation means 3 is provided.

The blanket installation means 3 is equipped with the aforementioned winding axis 31 and a winding axis operation means 32 (refer to FIG. 3), which is linked with both end portions of the aforementioned winding axis 31, which was projected from both side end faces of the blanket cylinder 2. At least both end vicinities of the winding axis 31 are rotatably supported at the side portions of the blanket cylinder 2 and a groove 311, which is parallel to the axis line, is provided at its outer periphery by at least the same length as the groove 22 of the aforementioned blanket cylinder 2 and by being coordinated with the position to an axis direction. As shown in FIG. 3, the winding axis operation means 32 has worm wheels 321 which were installed at the both end portions of the winding axis 31 and can be integrally rotated together with the winding axis 31, worms 322 which were geared with the worm wheels 321, an operation portion 323 for operating the rotation of the worms 322, and a stopping means (not illustrated) for stopping the worms 322 at a desired position.

A blanket 4 is installed on the blanket cylinder 2. As shown in FIG. 4, bars for blanket installation 41 and 42 made of, for example, aluminum are installed on the blanket 4 at both ends to a winding length direction which is longer than the circumferential length of the outer peripheral face 21 of the blanket cylinder 2, namely, the initial winding end and the terminal winding end, in at least full width of the blanket 4. Then, the initial winding end of the blanket 4 is inserted in the aforementioned groove 22, the rising face of a level difference rising from the rear side of the blanket of the bar for blanket installation 41, which was installed at the initial winding end, is hooked on the aforementioned level difference 212. Then, the blanket cylinder 2 is rotated in the direction A during printing operation and the blanket 4 is wound on the outer peripheral face 21 of the blanket cylinder 2. After the blanket cylinder 2 is rotated by about one rotation, the terminal winding end is inserted in the aforementioned groove 22 and further, the bar for blanket installation 42, which was installed at the terminal winding end, is inserted in the groove 311 of the blanket winding axis 31. Successively, the operation portion 323 of the winding axis operation means 32 shown in FIG. 3 is operated for rotation by an appropriate tool to rotate the worms 322, the angle of the blanket winding axis 31 is displaced through the worm wheels 321 which were geared with those, and the blanket 4 is installed by winding the terminal winding end of the blanket 4 on the blanket winding axis 31. By the installation, the initial winding end vicinity **4*a* (refer to FIG. 4) of the blanket 4 and the terminal winding end vicinity 4*b* (refer to FIG. 4) of the blanket 4 face mutually the blanket faces and are strained in a condition in which they are in parallel to the inner wall face 211 of the aforementioned groove 22 (refer to FIG. 4). Further, as shown in FIG. 4, a concave portion 45 is generated along a rim portion in parallel to the axial core of the blanket cylinder 2 of the opening portion of the groove 22. Further, one sheet of the blanket 4 is usually installed on the outer peripheral face 21 of the blanket cylinder 2, but 2 sheets of the blankets 4 and 4 are occasionally arranged to an axial direction to be installed in the blanket cylinder 2 which has a long length to an axial direction by which, for example, 4 pages of newspaper can be printed in arrangement to an axial direction, as shown in FIG. 3. Then, the filling member 1 related to the invention of the present application is installed for filling the aforementioned concave portion 45**.

As shown in FIG. 1 and FIG. 2, or as shown in FIG. 7 to FIG. 9 and FIG. 10 and FIG. 11, the filling member 1 comprises a wedge-shaped limb portion 11 and a head portion 12 and is formed at the length of the concave portion 45 formed on the aforementioned blanket cylinder 2, namely, the same length as the total of the width (the length to an axial direction of the blanket cylinder 2) of the blanket 4 which is installed on the blanket cylinder 2, or a length by which the length was suitably divided equally.

The limb portion 11 has the first oblique face 111 being one face disposed at about sharp angle $\beta$ (refer to FIG. 4) with respect to the top face 121 of a head portion 12 and the second oblique face 112 being another face disposed at a larger angle than the sharp angle β with respect to top face 121. The limb portion 111 is formed in a wedge shape, by setting the width of a free end portion as a half or less of a value which was obtained by subtracting twice the thickness dimension of the blanket 4 from the width dimension in a peripheral face direction of the opening portion of the groove 22 of the aforementioned blanket cylinder 2, and by setting the width of a portion adjacent to the head portion as a slightly larger value of a value which was obtained by subtracting twice the thickness dimension of the blanket 4 from the width dimension in a peripheral face direction of the opening portion of the groove 22 of the aforementioned blanket cylinder 2. Further, the aforementioned sharp angle β is the complementary angle of an angle α which the inner wall face 211 of the aforementioned groove 22 forms against the radial direction of the blanket cylinder 2.

Further, it is desirable that the limb portion 11 is formed having a length which reaches at least at a level difference by which the aforementioned free end portion rises from the blanket face of the bar for blanket installation 41, which was installed at the initial winding end of the aforementioned blanket 4. Specifically, it is desirable that the free end portion of the limb portion 11 is brought in contact with the rising face 411 of the level difference, which rises from the blanket face as shown in FIG. 5, or it is desirable that the second oblique face 112 is brought in contact with the upper face 412 of the level difference, which rises from the blanket face as shown in FIG. 6.

The head portion 12 is formed in a somewhat triangular shape whose vertical section is a trumpet shape to a longitudinal direction, in which one of two side rims of the top face 121, which is the at most same width dimension to a peripheral face direction of the opening of the groove 22 of the aforementioned blanket cylinder 2, is linked with the first oblique face 111 of the aforementioned limb portion 11 and another portion is linked with the second oblique face 112 of the aforementioned limb portion 11, respectively, by the first concave curved face 122 and the second concave curve face 123. Herein, the first concave curve face 122 is a curve face which is nearly coordinated with a convex curved face on which the terminal winding end side 4*b* of the blanket 4 installed is bent toward the inside of the groove 22 along the rim of the opening portion of the groove 22, and the second concave curved face 123 is a curved face which is nearly coordinated with a convex curved face on which the initial winding end side 4*a* of the blanket 4 installed is bent toward the inside of the groove 22 along the rim of the opening portion of the groove 22. Further, the top face 121 of the head portion 12 may be appropriately formed in various shapes such as in a tabular shape as shown in FIG. 2, a circumferential face shape as shown in FIG. 10, which comprises a radius R which is nearly coordinated with an outer peripheral face of the blanket cylinder 2 after installing the blanket 4, a shape in which the top of a circumferential face as shown in FIG. 10 was cut in a tabular shape as shown in FIG. 11, and the like, so far as it is a shape by which the filling member 1 does not lose a desired action effect. Furthermore, it is confirmed by the test of the applicant that when the dimension to a peripheral face direction of the blanket cylinder 2 of the aforementioned concave portion 45 is small, the desired action effect of the filling member 1 is obtained by the filling member 1 which formed the head portion 12, without providing the first concave curved face 122 as shown in FIG. 7 to FIG. 9, or without providing the first concave curved face 122 and the second concave curved face 123.

Further, the filling member 1 is made of, for example, a single elastomer material, for example, a nitrile butadiene rubber (NBR), and the limb portion 11 is formed in a hard sense. Further, the portion at least in the vicinity of the top face 121 of the head portion 12, for example, 1.5 to 2 mm from the top 121 is formed in a soft sense by changing a mixing ratio of a curing aid. Namely, it is integrally formed so that the durometer hardness of the limb portion 11 is 90 to 100 and the durometer hardness of the vicinity of the top 121 of the head portion 12 is 30 to 80, and a material forming the hard portion and a material forming the soft portion are mixed nearby the boundary of the hard portion and the soft portion to form a laminar shape having a slight thickness in which the hardness changes gradually at an intermediary hardness of both. Further, the limb portion 11 and the head portion 12 are formed at a durometer hardness of 30 to 80 by the aforementioned elastomer material and either or both of the first oblique face 111 of the limb portion 11 or the second oblique face 112 may be formed by binding a hard reinforcing plate material 115 such as a metal plate, shown as in FIG. 9. Furthermore, the head portion 12 is formed at a durometer hardness of 30 to 80 by the aforementioned elastomer material and the limb portion 11 and the head portion 12 are formed by materials having different hardness and both may be bonded to be formed. Then, the coupling and the coupling of the aforementioned reinforcing plate material 115 may be appropriate embodiments so far as they are a coupling by which the filling member 1 does not lose a desired action effect.

The filling member 1 which was formed as described above is installed as below.

Namely, the free end portion of the limb portion 11 is faced to the concave portion 45 which is formed by mutually facing the initial winding end vicinity 4*a* of the blanket 4 and the terminal winding end vicinity 4*b* of the blanket 4, and the first oblique face 111 is brought into contact with the surface of the terminal winding end 4*b* of the blanket 4 and inserted into the concave portion 45 according to the slant of the surface of the terminal winding end 4*b*. Since the limb portion 11 is formed in hard sense and a wedge shape, the limb portion can be inserted by easily wrenching open the gap even when the gap between the aforementioned initial winding end vicinity 4*a* and terminal winding end vicinity 4*b* is blocked because the blanket 4 installed does not exactly fit the rim of the opening portion of the groove 22. Insertion is trouble free and a specific technique is not required for the insertion. Then, when the insertion proceeds and the top 121 of the head portion 12 is coordinated with the outer peripheral face 43 of the blanket 4, which was installed on the blanket cylinder 2, the first concave curve face 122 of the head portion 12, the second concave curve face 123 and the overhang oblique face 123*a* in place of the second concave curve face 123 are respectively brought into contact with a convex curve face on which the blanket 4 installed is bent toward the inside of the groove 22 along the rim of the opening portion of the groove 22, and the filling member is prevented from proceeding into the inner part of the concave portion 45. Additionally, a site adjacent to the head portion 12 of the limb portion 11, which was formed slightly larger than the gap between the aforementioned initial winding end vicinity 4*a* and terminal winding end vicinity 4*b*, is strongly pushed to the surface of the terminal winding end vicinity 4*b*, which involves the first oblique face 111, and to the surface of the initial winding end vicinity 4*a*, which involves the second oblique face 112, respectively to be brought in contact. The filling member 1 is fixed in the concave portion 45 by the contact frictional force.

Then, in the fixed condition, when the free end portion of the limb portion 11 is brought into contact with the rising face 411 of the level difference, which rises up from the blanket face of the bar for blanket installation 41 that was provided at the initial winding end of the blanket cylinder 2, a force which is forwarded in the inside of the groove 22 and is parallel to a direction to which the initial winding end side of the blanket cylinder 2 and the terminal winding end side are strained is created on the filling member 1. For example, when the separate force of the printing pressure is created, a repulsive force corresponding to the separate force of the printing pressure is created on the filling member 1 from the aforementioned rising face 411, and the positional condition in which the filling member 1 was installed is maintained for a longer time, in combination with the action of the frictional force caused by contact of the aforementioned limb portion 11 with the blanket 4, with a stopper action which is caused by the contact of the first concave curved face 122 of the head portion 12, the second concave curved face 123 and the overhang oblique face 123*a* in place of the second concave curve face 123 with a convex curved face on which the blanket 4 is bent toward the inside of the groove 22 along the rim of the opening portion of the groove 22.

Further, in the aforementioned fixed condition, when the second oblique face 112 of the limb portion 11 is brought into contact with the upper face 412 of the level difference, which rises up from the blanket face of the bar for blanket installation 41 that was provided at the initial winding end of the blanket cylinder 2, when the blanket 4 is strongly stripped off at the terminal winding end side by printing operation at which the blanket cylinder 2 is rotated being brought into contact with another adjacent printing cylinder 5 (refer to FIG. 4), the initial winding end side is slightly pulled out from the inside of the groove 22 and the terminal winding end side is deformed so as to be slightly bent in the groove. Therefore force which is forwarded to outside from the inside of the groove 22 is created on the second oblique face 112 of the limb portion 11 which contacts with the surface of the blanket cylinder 2 and force which is forwarded in the inside of the groove 22 is created on the first oblique face 111. Then, the filling member 1 is prevented from a clockwise angle displacement in FIG. 4 and the posture at which the filling member 1 was installed is maintained by using the contact point of the initial winding end side of the blanket 4 with the second oblique face 112 of the limb portion 11 as a fulcrum.

As described above, the concave portion 45 is filled with the filling member 1 on the blanket cylinder 2 on which the blanket 4 and the filling member 1 were installed and coincides with the outer peripheral face 43 of the blanket 4 on which the top 121 of the filling member 1 was installed, and the top vicinity 121 of the filling member 1 was nearly as hard as the surface of the blanket 4 installed. Therefore even if contact rotation is carried out during printing operation under printing pressure action with another adjacent printing cylinder 5 (refer to FIG. 4) which is, for example, a printing cylinder, a blanket cylinder or a pressure cylinder, there is no great fluctuation of printing pressure caused by the concave portion 45, there is no printing hindrance such as shock-streak, doubling or the like which is generated by the fluctuation of printing pressure, and there is also no invasion of paper powder, an ink and the like to the groove 22.

Further, according to the test by the applicant, it is confirmed that when the top 121 of the head portion 12 forms a face which is nearly coordinated with the outer peripheral face of the blanket cylinder 2 which installed the blanket 4, the filling member 1 obtains a desired action effect. When the dimension to a peripheral face direction of the concave portion 45 is small, it is needless to say that there is no problem even if the top 121 is a flat face.

As described above, according to the composition of the filling member of the blanket cylinder related to the present invention, the wedge-shaped limb portion is inserted and installed along the blanket which was strained along the inner wall face of a groove provided in a sharp angle against the radial direction of the cylinder, and installed approximately parallel and adjacent to at least the head portion of both faces forming a wedge shape. The limb portion is pushed on the aforementioned blanket faces facing approximately parallel. Therefore even if the separate centrifugal force generated during printing operation is created in a pulling-up direction, a frictional force caused by the contact of the limb portion with the blanket faces resists the aforementioned separate centrifugal force and the filling member is not removed from the blanket cylinder.

Further, since the insertion direction at installation is different from the action direction of printing pressure, and further the head portion fills the concave portion of the blanket faces, even if printing pressure acts at the time of printing operation, the head portion formed in a comparatively soft sense corresponds softly to the printing pressure during printing operation to minimize the fluctuation of the printing pressure, and the aforementioned frictional force caused by the contact of the limb portion with the blanket faces and the head portion filling the concave portion of the blanket faces keep the position condition in which the filling member was installed.

Further, since the limb portion is a wedge shape and can be inserted or pulled out between the surface at the initial winding end side of the blanket and the surface of the terminal winding end side facing approximately parallel in a condition in which one face of the wedge-shaped limb portion is contacted with the surface of the terminal winding end side of the blanket, the installation to and removal from the blanket cylinder of the filling member can be carried out without requiring any skilled technique and by comparatively small force.

Further, according to the further composition of the filling member of the blanket cylinder related to the present invention, in addition to the above-mentioned effect, since the edge portion of the limb portion is brought into contact with the rising face of the level difference which rises up from the blanket face of the bar for blanket installation, a repulsive force corresponding to the separate force of the printing pressure is generated, and the positional condition in which the filling member was installed is maintained for a longer time, in combination of the action of the frictional force caused by contact of the aforementioned limb portion with the blanket face, with the action of the head portion which fills the concave portion of the blanket face.

Further, according to the composition of the filling member of the blanket cylinder related to the present invention, in addition to the above-mentioned effect, since another face forming the wedge shape of the limb portion is brought into contact with the upper face of the level difference which rises up from the blanket face of the bar for blanket installation, the blanket is strongly stripped off at the terminal winding end side by printing operation which is rotated being brought in contact with an adjacent cylinder, force which is forwarded in the inside of the groove is created on one face of the wedge-shaped limb portion in contact with there when the terminal winding end side is slightly sent in the groove. Therefore the filling member prevents the angle displacement to the initial winding end side by using the contact point of the initial winding end side of the blanket with the other face of the limb portion as a fulcrum and keeps the posture by which the filling member was installed.

I claim:

1. A gap filling member for a blanket cylinder which fills a concave portion of a blanket face which is generated along the opening portion of a groove of the blanket cylinder, in which the inner wall of the groove opened at the outer peripheral face of the cylinder in parallel with an axial line is provided at a fixed sharp angle against the radius direction of the cylinder at the center of the cylinder peripheral face of the opening portion, the blanket being wound on the outer peripheral face of the cylinder, an initial winding end side and a terminal winding end side of the blanket respectively being linked with a blanket installation means which is provided in the groove by a bar for blanket installation and the blanket being strained approximately parallel with the inner wall face by the blanket installation means, comprising:

a wedge-shaped limb portion;

a head portion for filling the concave portion;

wherein the limb portion is strengthened to be inserted between a surface of the terminal winding end side of the blanket face and a surface of the initial winding end side of the blanket face approximately parallel with the surfaces in a condition in which one face of the limb portion is contacted with the surface of the terminal winding end side of the blanket strained along the inner wall face and is formed in a shape in which the one face and another face forming a wedge-shape with the one face can be pushed on both surfaces of the blanket which face approximately parallel to at least a site adjacent to the head portion, the head portion is formed in a shape to fill the concave portion when the limb portion is inserted between the initial winding end side and the terminal winding end of the blanket, the limb portion is comprised of material that is harder than material comprising the head portion, and a top face of the head portion is not covered when inserted into the blanket cylinder.

2. The gap filling member for a blanket cylinder according to claim 1, wherein an edge of the limb portion is formed so as to be brought into contact with a rising face of level difference which rises from the blanket face of a bar for blanket installation which was provided at the initial winding end.

3. The gap filling member for a blanket cylinder according to claim 1, wherein the another face forming the wedge shape of the limb portion is formed so as to be brought into contact with an upper face of level difference which rises from the blanket face of a bar for blanket installation which was provided at the initial winding end.

* * * * *